US005937818A

United States Patent [19]

Kawai et al.

[11] Patent Number: 5,937,818

[45] Date of Patent: Aug. 17, 1999

[54] VENTILATION SYSTEM FOR OUTBOARD MOTOR

[75] Inventors: Takaji Kawai; Yoshifumi Iwata, both of Hamamatsu, Japan

[73] Assignee: Sanshin Kogyo Kabushiki Kaisha, Hamamatsu, Japan

[21] Appl. No.: 08/996,073

[22] Filed: Dec. 22, 1997

[30] Foreign Application Priority Data

Dec. 20, 1996 [JP] Japan ..... 8-341859

[51] Int. Cl.[6] ..... F02B 77/00

[52] U.S. Cl. ..... 123/198 E; 123/41.05; 440/77

[58] Field of Search ..... 123/198 E, 41.05, 123/41.06, 41.12; 440/76, 77, 900

[56] References Cited

U.S. PATENT DOCUMENTS

| | | | |
|---|---|---|---|
| 3,964,444 | 6/1976 | Hemmann et al. | 123/41.12 |
| 4,168,456 | 9/1979 | Isobe | 123/41.12 |
| 4,409,933 | 10/1983 | Inoue | 123/41.12 |
| 4,774,910 | 10/1988 | Aihara et al. | 123/41.12 |
| 4,924,826 | 5/1990 | Vinson | 123/198 E |
| 5,445,547 | 8/1995 | Furukawa | 440/77 |
| 5,713,772 | 2/1998 | Takahashi et al. | 123/198 E |
| 5,743,228 | 4/1998 | Takahashi | 440/78 |

*Primary Examiner*—Noah P. Kamen
*Attorney, Agent, or Firm*—Knobbe, Martens, Olson & Bear LLP

[57] ABSTRACT

A ventilating system for an outboard motor having a water propulsion device and an internal combustion engine positioned in a cowling, the engine having an output shaft arranged to drive the water propulsion device, is disclosed. The ventilating system includes an air inlet in the cowling which permits air to flow into an engine compartment in which the engine is positioned, and an exhaust port positioned in the cowling. The system also includes a mechanism for drawing air through the inlet into the compartment and expelling air out of the compartment through the exhaust port after the engine has stopped.

5 Claims, 6 Drawing Sheets

VENTILATION SYSTEM FOR OUTBOARD MOTOR

FIELD OF THE INVENTION

The present invention relates to a ventilating system. More particularly, the invention is an improved ventilating system for an outboard motor having a water propulsion device powered by an internal combustion engine positioned in a cowling.

BACKGROUND OF THE INVENTION

Outboard motors are often used to power watercraft. These motors have a water propulsion device which is powered by an internal combustion engine. In order to protect the engine from water and other elements, the engine is positioned in an enclosed cowling of the motor.

The size of the cowling is minimized to reduce the air drag associated with the motor. This in turn reduces the space within the cowling in which the engine is positioned. As a result, heat generated by the engine is trapped within the cowling.

The high temperature conditions within the outboard motor cowling reduce the efficiency of the engine, and may result in damage to the engine or its related components. Liquid cooling systems are often employed to reduce the temperature of the engine. Such systems generally include a coolant pump which is driven by the engine and routes coolant through one or more cooling passages through the engine. These cooling systems are designed to cool the engine itself, and are not as effective in reducing the temperature of the air surrounding the engine within the cowling or the associated accessories. As a result, the engine accessories are still often heated to high temperatures and the air which is drawn by the engine for combustion is often at a very high temperature.

In addition, when the engine is stopped, the liquid cooling system stops delivering coolant to the engine. As a result, the retained heat of the engine is transmitted to the engine accessories and the surrounding air within the cowling, raising their temperature very high.

An outboard motor having a water propulsion device powered by an internal combustion engine positioned in a cowling of the motor and arranged to overcome the above-stated problems is desired.

SUMMARY OF THE INVENTION

In accordance with the present invention, there is provided a ventilating system for an outboard motor. Preferably, the motor is of the type which has a powerhead comprising an internal combustion engine positioned in a cowling. The motor includes a water propulsion device which is powered by the engine.

The ventilating system includes an air inlet positioned in the cowling permitting air to flow into an engine compartment in which the engine is positioned, and an exhaust port positioned in the cowling. The system also includes means for drawing air through the inlet into the engine compartment and expelling air out of the compartment through the exhaust port after the engine has stopped.

In a preferred embodiment, the means comprises an electrically-powered fan and a control for controlling the operating fan.

In one arrangement, the means is arranged to draw air into the engine compartment and expel it through the exhaust port for a predetermined time after the engine has stopped. In another arrangement, the means is arranged to draw air into the engine compartment and expel it through the exhaust port until the temperature of the engine or the temperature of the air in the engine compartment falls to a predetermined temperature.

In accordance with the present invention, the ventilating system in arranged to route air through the cowling even after the engine is shut off or has stopped running, whereby the temperature within the cowling is kept low.

Further objects, features, and advantages of the present invention over the prior art will become apparent from the detailed description of the drawings which follows, when considered with the attached figures.

DETAILED DESCRIPTION OF THE PREFERRED EMBODIMENTS OF THE INVENTION

Figure 1:
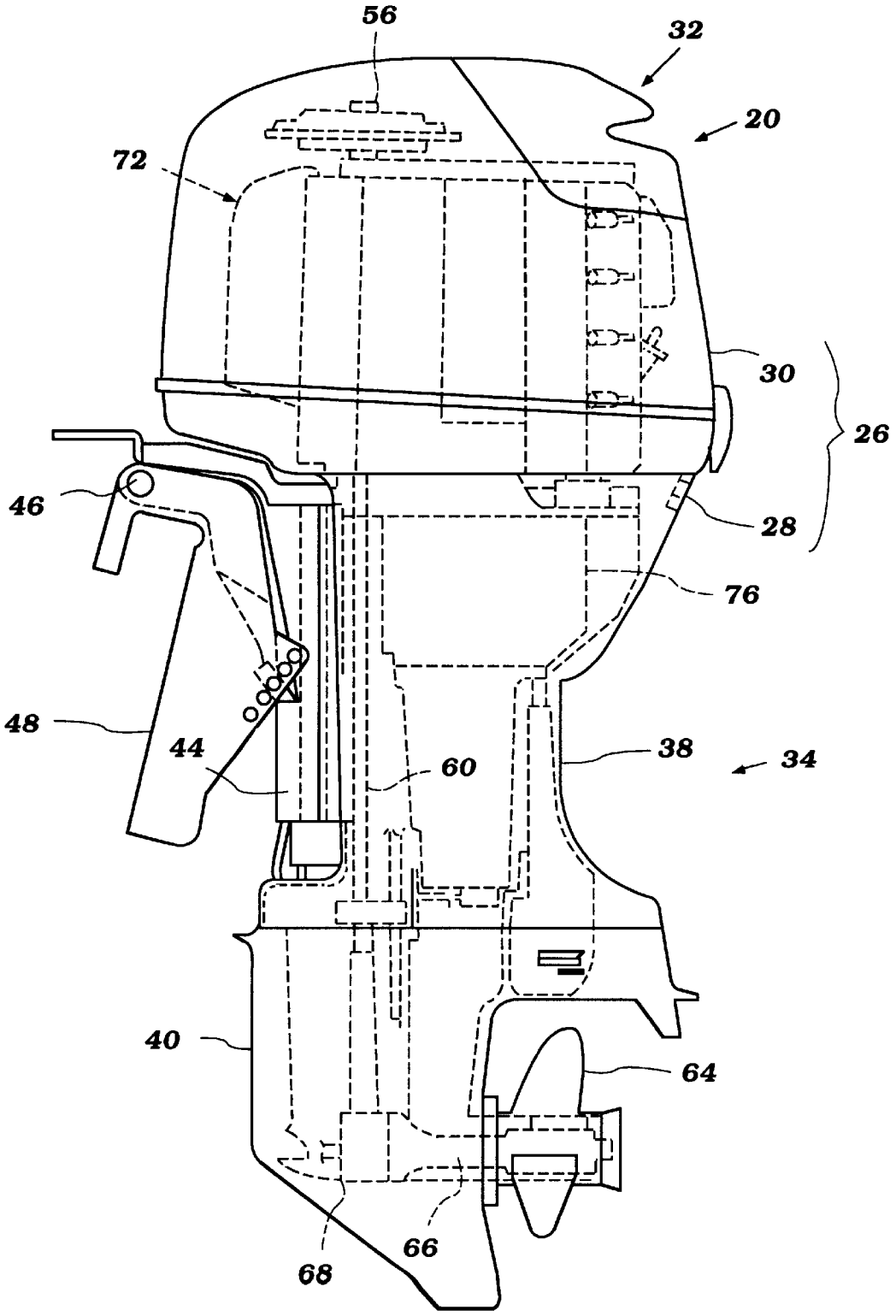
FIG. 1 is a side view of an outboard motor having a water propulsion device powered by an engine positioned in a cowling of the motor.

In accordance with the present invention there is provided a ventilating system for an outboard motor such as that illustrated generally in FIG. 1, the motor 20 having a water propulsion device powered by an internal combustion engine positioned in a cowling of the motor. The ventilating system of the present invention is described for use with an outboard motor having an engine positioned in a cowling thereof since this is an application for which the system has particular advantages. Those of skill in the art will appreciate that the system may be adapted for use in a variety of other applications.

Referring to FIG. 1, the outboard motor 20 has a powerhead 26 comprised of a lower tray portion 28 and a main cowling portion 30. An engine 22 is positioned in the powerhead 26 of the motor 20 and is thus enclosed within the main cowling portion 30. An air inlet 32 is provided in the main cowling portion 30 for providing air to the engine 22 therein. The motor 20 includes a lower unit 34 extending downwardly from the cowling portion 30. The lower unit 34 comprises an upper or "drive shaft housing" section 38 and a lower section 40.

The motor 20 is arranged to be movably mounted to a watercraft (not shown). Preferably, the motor 20 is connected to a steering shaft (not shown). The steering shaft is supported for steering movement about a vertically extending axis within a swivel or swivel bracket 44. The mounting of the motor 20 via the steering shaft with respect to the swivel bracket 44 permits the motor 20 to be rotated about the vertically extending axis through the swivel bracket 44. In this manner, the motor 20 may be turned to direct the watercraft which it is used to propel.

The swivel bracket 44 is connected by means of a pivot pin 46 to a clamping bracket 48 which is adapted to be attached to a transom portion of a hull of a watercraft. The pivot pin 46 permits the outboard motor 20 to be trimmed and tilted up about the horizontally disposed axis formed by the pivot pin 46.

Referring to FIG. 1, the powerhead 26 of the outboard motor 20 includes the engine 22 which is positioned within the main cowling portion 30. The engine 22 is preferably of the four-cylinder variety, arranged in in-line fashion and operating on a four-cycle operating principle. As may be appreciated by those of skill in the art, the engine 22 may have a greater or lesser number of cylinders, such as two, six, or eight or more. In addition, the engine 22 may have its cylinders arranged in "V", opposing or other arrangements, and the engine 22 may operate on a two-cycle or other principle.

The particular construction of the engine 22 forms no part, per se, of the invention herein, and is thus not described in detail. Those of skill in the art will appreciate the numerous manners in which the engine 22 may be constructed and arranged. In the preferred arrangement, and referring to FIG. 2, the engine 22 has a cylinder block 52 with a cylinder head 54 connected thereto and cooperating therewith to define the four cylinders. Though not illustrated, a piston is movably positioned in each cylinder, and connected via a connecting rod to a vertically extending crankshaft 56. Referring to FIG. 1, one end of the crankshaft 56 extends below the engine 22 and is arranged to drive a drive shaft 60 which extends downwardly through the lower unit 34, where it is arranged to drive a water propulsion device of the motor 20.

Preferably, this water propulsion device comprises a propeller 64. The propeller 64 is connected to a propeller shaft 66. The propeller shaft 66, and thus the propeller 64, is preferably driven by the drive shaft 60 through a conventional forward-neutral-reverse transmission 68. The transmission is not illustrated in detail and may be of a variety of types known to those of skill in the art. A control is preferably provided for allowing an operator to remotely control the transmission, such as from the watercraft.

The crankshaft 56 is journalled for rotation with respect to the cylinder block 52. A crankcase cover 70 engages an end of the block 52, cooperating therewith to define a crankcase chamber within which the crankshaft rotates. The crankcase cover 70 may be attached to the cylinder block 52 by bolts or similar means for attaching (not shown), as known to those skilled in the art.

The engine 22 includes an air intake system. The intake system is not described in detail herein but, referring to FIG. 2, preferably includes the intake vent 32 in the main cowling 30. The intake 32 preferably comprises a cover element 80 cooperating with the main cowling 30 to define an intake space 86 having an inlet 82 leading to the space outside of the motor 20. An intake riser 88 having an intake passage therethrough extends from the main cowling 30 upwardly into the intake space 86.

In this arrangement, air surrounding the motor 20 is drawn through the inlet 82 into the intake space 86. This air then flows through the passage in the riser 88 into the engine compartment within the powerhead 26. The riser 88 is adapted to prevent the flow of water and similar debris and contaminants into the main cowling 30 through the intake 32.

Air within the cowling 30 is then drawn through a suitable engine intake system arranged to deliver air to each cylinder.

The engine 22 includes a fuel system for providing fuel to the engine for combustion with the air. A suitable ignition system is also provided for igniting the air and fuel mixture. Such systems are well known to those skilled in the art, and as they form no part of the invention herein, they are not described in detail here.

Similarly, an exhaust system is provided for routing the products of combustion from the engine. This exhaust system is not illustrated in detail, but preferably includes an exhaust passage leading from each cylinder to an exhaust expansion chamber 76 positioned below the engine 22 in the lower unit 34. The exhaust is preferably routed from the expansion chamber 76 to a point external to the motor 20, such as through a through-the-propeller hub discharge.

In accordance with the present invention, the motor 20 is provided with a ventilating system for ventilating the space within the powerhead 26 defined by the main cowling 30 and lower tray 28. A first embodiment ventilating system is illustrated in FIG. 2 and adapted for use with a motor such as that illustrated therein and in FIG. 1.

Figure 2:
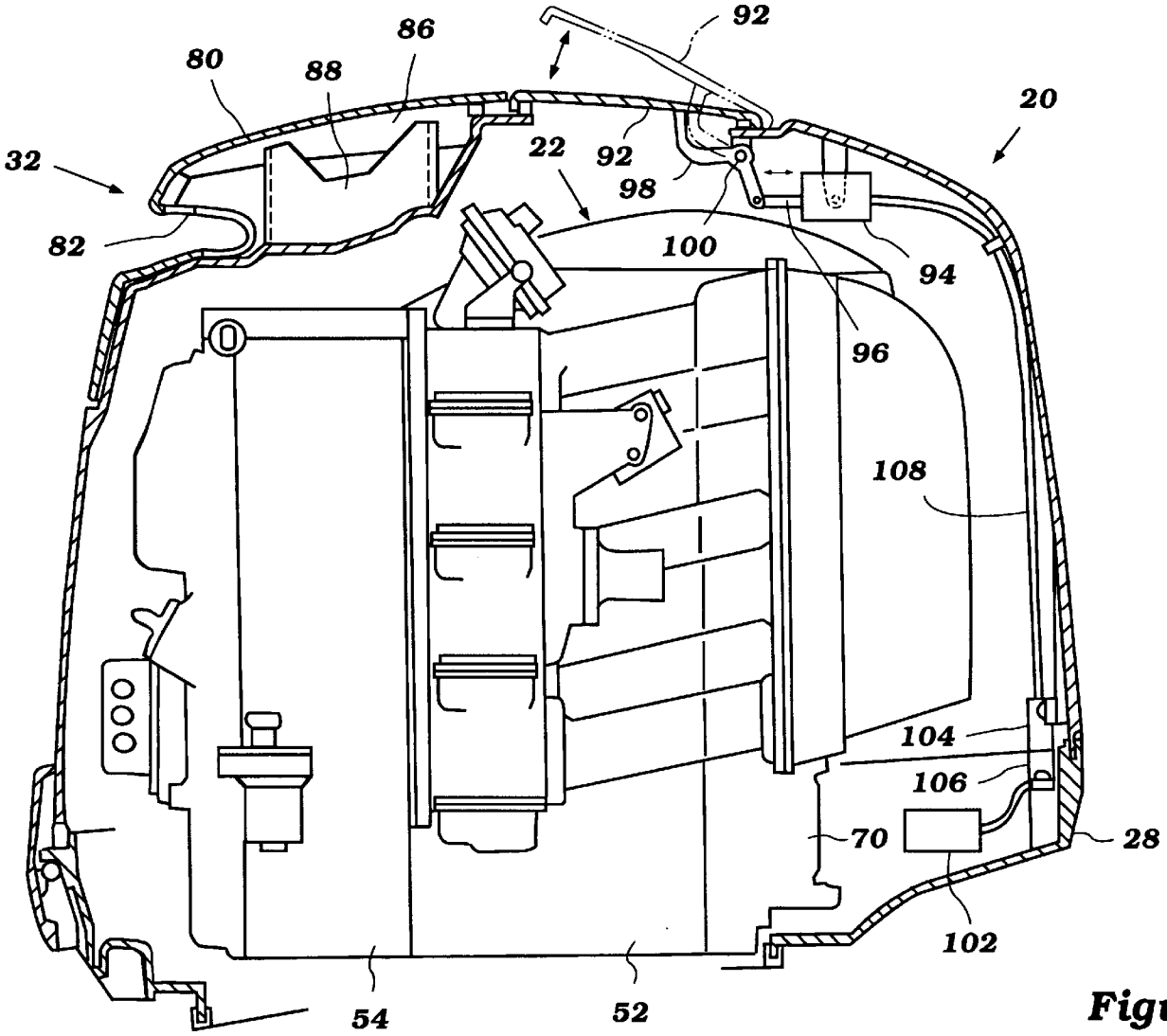
FIG. 2 is a cross-sectional side view of a powerhead portion of a motor such as that illustrated in FIG. 1 as including a ventilating system in accordance with a first embodiment of the present invention.

Referring to FIG. 2, an exhaust vent or port 90 is provided in the main cowling 30 through which air within the engine compartment may be expelled to a point external to the motor 20. Preferably, this vent or port 90 comprises an opening in the top of the main cowling portion 30 above the engine 22, the opening preferably selectively opened and closed with a cover 92.

As illustrated, the cover 92 is preferably hinged at a first end or edge to the cowling 30. While the cover 92 may be manually moved, means are preferably provided for automatically moving the cover 92 between a first position in which the cover 92 closes the opening and a second position in which the cover 92 is raised and does not obscure the opening.

Preferably, this means comprises an electrically-powered operating mechanism. This mechanism includes a solenoid 94 arranged to move the cover 92 through a linkage. As illustrated, the linkage includes an arm 96 which is actuated by the solenoid 94 and connected to a first end of a lever 98. The lever 98 is rotatably mounted to the cowling 30 about a pin 100 and has its second end connected to the cover 92 some distance from its hinged edge.

A control 102 is provided for selectively powering the solenoid 94. This control 102 is preferably arranged to power the solenoid 94 in a manner described below. The control 102 selectively sends power from a power source, such as a battery (not shown) through a lead wire 108 leading to the solenoid 94. In the arrangement illustrated, first and second connectors 104,106 are positioned along the wire 108 at the intersection of the main cowling 30 and lower tray 28. These connectors 104,106 may be selectively connected or disconnected, permitting the main cowling 30 to be removed from the lower tray 28.

In operation, when the temperature within the cowling 30 exceeds a predetermined high temperature, the control 102 is arranged to activate the solenoid 94 and move the cover 92 to its open or raised position. When this occurs, the solenoid 94 is powered and moves the arm 96 to the left in FIG. 2, causing the second end of the lever 98 to move upwardly, rotating the cover 92 to its raised position. In this position, hot air within the cowling 30 is permitted to escape therefrom and be replaced with cooler air drawn through the intake 32.

Alternatively, when the engine 22 is not running or the temperature within the cowling 30 is low, the control is arranged to close the cover 92.

Most preferably, and in accordance with the present invention, the control 102 is arranged to open and maintain the cover 92 in its open position after the engine 22 has stopped. In particular, when the engine 22 is shut off, the control 102 is preferably arranged to maintain the cover 92 in the open position for a predetermined time. The control 102 may then be arranged to close the cover 92 to protect the engine 22.

In a second arrangement, the control 102 may be arranged to maintain the cover 92 in an open position after the engine 22 is shut off until the temperature of the engine 22 falls below a predetermined temperature. In this embodiment, a temperature sensor preferably provides engine temperature data to the control 102. The control 102 may be arranged to maintain the cover 92 in the open position until the engine temperature falls below to the ambient air temperature (which may also be measure by an appropriate temperature sensor) or other temperature. Also, the control 102 may be arranged to maintain the cover 92 in an open position until the temperature of the air within the cowling 30 falls below a predetermined temperature.

In accordance with the invention as described, hot air vents from the cowling 30 even after the engine 22 is shut off, preventing the engine 22 from over-heating the interior space within the cowling and over-heating engine accessories and the like.

Those of skill in the art will appreciate that other mechanisms may be used to move the cover 92. For example, a toothed structure may be mounted at the first end of the lever 98 for engagement with a gear driven by a motor. Alternatively, a belt drive may be provided for moving the cover 92. Also, the solenoid arm 96 may be directly connected to the cover 92 and arranged to move the cover 92 directly (such as by orienting the solenoid 94 so that the arm 96 is generally vertically extending).

Figure 3:
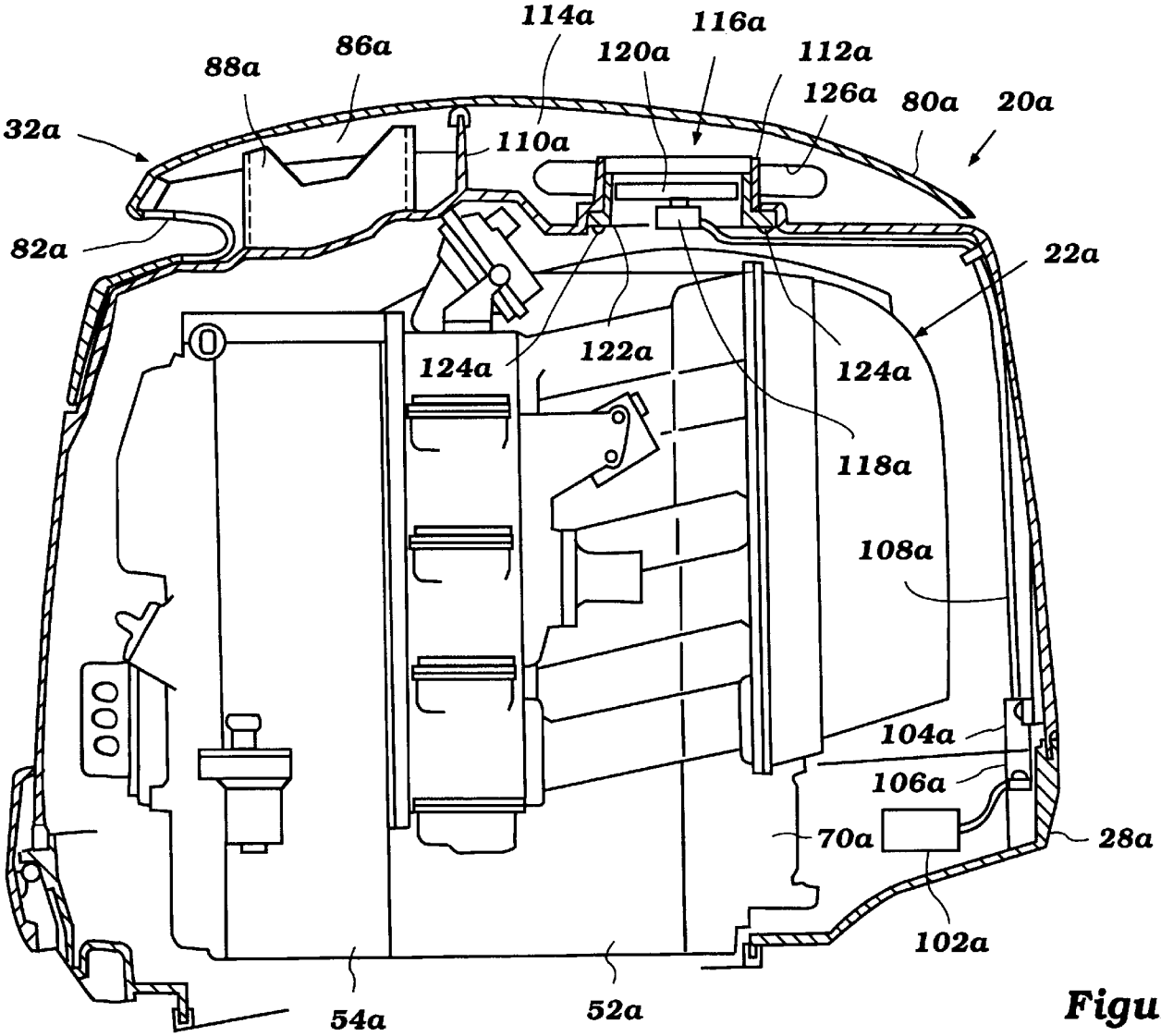
FIG. 3 is a cross-sectional side view of a powerhead portion of a motor such as that illustrated in FIG. 1 as including a ventilating system in accordance with a second embodiment of the present invention.

A second embodiment of a ventilating system in accordance with the present invention is illustrated in FIG. 3. This embodiment system is useful with an outboard motor of the type illustrated in FIG. 1 as modified as illustrated in FIG. 3. In the description and illustration of this embodiment, like parts have been given to like or similar reference numerals to those utilized in the description of the embodiment above, except that an "a" designator has been added to all of the reference numerals used herein.

In this embodiment, the cowling 30*a* has a top or upper surface having the riser 88*a* extending upwardly therefrom, along with a divider 110*a*, and has an exhaust opening 112*a* therein. The cover 80*a* preferably extends over the entirety of the top of the cowling 30*a*.

The cover 80*a* cooperates with the cowling 30*a* to define the inlet chamber 86*a* and an exhaust chamber 114*a*, the two chambers separated by the divider 110*a* which extends upwardly from the cowling 30*a*.

Means are provide for exhausting or expelling air from within the cowling 30*a* through the exhaust opening 112*a*. Preferably, this means comprises a fan 116*a*. The fan 116*a* has a blade 120*a* which is positioned in the opening 112*a*. The blade 120*a* is preferably driven by an electrically operated motor 118*a*. The fan 116*a* is preferably supported by a housing element 122*a* which is positioned in the opening 112*a* and supported by the cowling 30*a* by bolts 124*a* or similar attachment means.

A control 102*a* is provided for operating the fan 116*a*. Preferably, this control 102*a* is arranged to control the fan 116*a* as described below by selectively permitting power to flow through a lead wire 108*a* from power source.

In operation, when the temperature of the air within the cowling 30*a* exceeds a predetermined high temperature, the control 102*a* is arranged to activate the fan 116*a*. When this occurs, power is provided to the fan 116*a* through the wire 108*a*, with the motor 118*a* turning the blade 120*a*. The blade 120*a* is arranged to draw air from within the cowling 30*a* and force it outwardly through the opening 112*a* into the exhaust chamber 114*a*. The exhausted air then flows through at least one exhaust opening 126*a* formed in the cover 80*a* and leading therethrough to a point external to the motor 20*a*.

In this manner, heated air from within the cowling 30*a* is expelled from the cowling and replaced by cooler air drawn into the cowling through the intake vent 32*a*. This has the effect of lowering the temperature within the cowling 30*a*.

When the temperature within the cowling 30*a* is low and/or the engine 22*a* temperature is low, the control is arranged to prevent the operation of the fan 116*a*. This permits the engine 22*a* to warm up.

Figure 4:
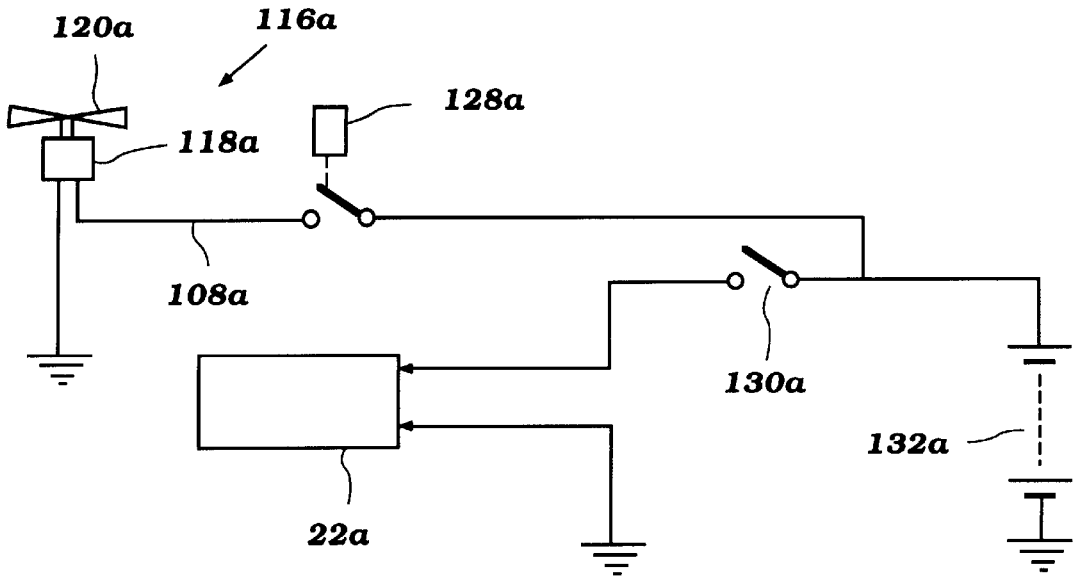
FIG. 4 is a schematic illustrating a control circuit for a fan of the ventilating system illustrated in FIG. 3.

A circuit for controlling the fan 116*a* is illustrated in FIG. 4. As illustrated, a power source 132*a* is provided for powering the motor 118*a* of the fan 116*a*. This power source 132*a* may comprise a battery, generator or the like. A main switch 130*a* is preferably provided between the power source 132*a* and the engine 22*a* for controlling the power to the engine 22*a*, such as the ignition system.

In this embodiment, a power feed circuit leads from the power source 132*a* in a manner unswitched or uncontrolled by the main switch 130*a*. The control 102*a* includes a thermostat-controlled switch 128*a* provided along this feed circuit for controlling the flow of power to the motor 118*a* of the fan 116*a*. In this arrangement, even if the power has been shut off to the engine 22*a* with the main switch 130*a*, power is still permitted to flow to the fan 116*a*. Thus, even if the engine 22*a* is not running, the fan 116*a* may still be powered to cool down the space within the cowling 30*a* in the manner described below.

Figure 5:
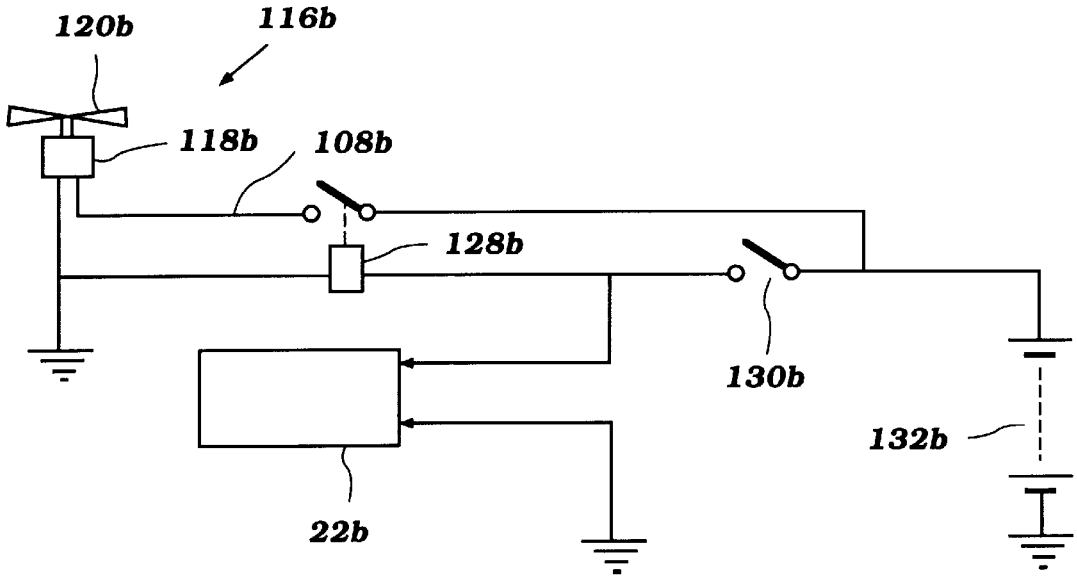
FIG. 5 is a schematic illustrating an alternate control circuit for the fan of the ventilating system illustrated in FIG. 3.

An alternate arrangement control circuit is illustrated in FIG. 5. In the description and illustration of this circuit, like parts have been given like reference numerals to those utilized in the description of the circuit illustrated in FIG. 4, except that a "b" designator has been added to all of the reference numerals used herein. In this embodiment, the circuit is arranged with a timer element 128*b*. When the engine 22*b* is stopped, the element 128*b* is arranged to close the main switch 130*b* and the switch providing power to the fan 116*b* for a predetermined amount of time.

In accordance with this second embodiment of the invention, the fan 116*a,b* is preferably arranged to run even after the engine 22*a,b* is shut off. In one arrangement, such as by using the circuit illustrated in FIG. 4 and described above, the fan 116*a,b* is activated until the temperature of the engine 22*a,b* or the air temperature in the cowling falls below a predetermine temperature. In an alternate embodiment, such as by using the circuit illustrated in FIG.

5 and described above, the fan 116*a,b* may be arranged to run for a predetermined time after the engine is shut off. In either case, the invention is arranged to route cool air into the cowling even after the engine 22*a,b* is shut off.

Figure 6:
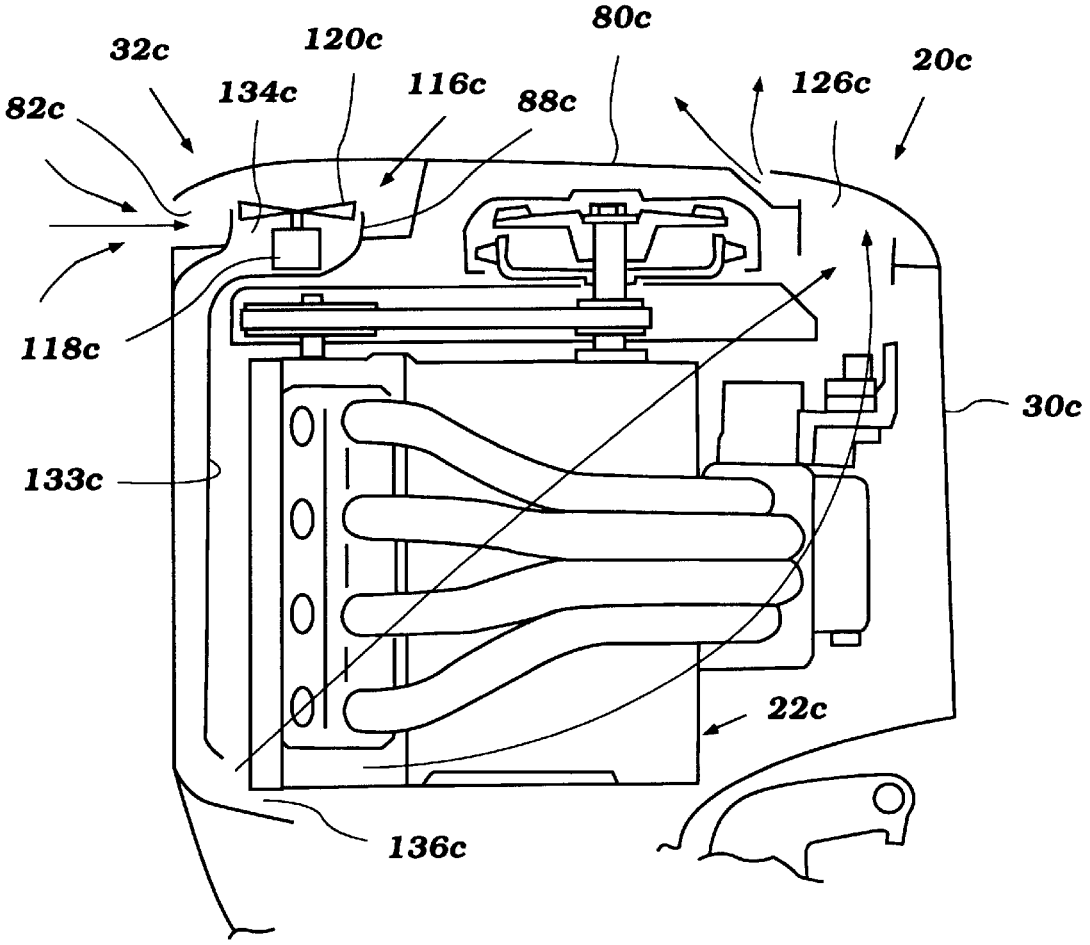
FIG. 6 is a cross-sectional side view of a powerhead portion of a motor such as that illustrated in FIG. 1 as including a ventilating system in accordance with a third embodiment of the present invention.
Figure 7:
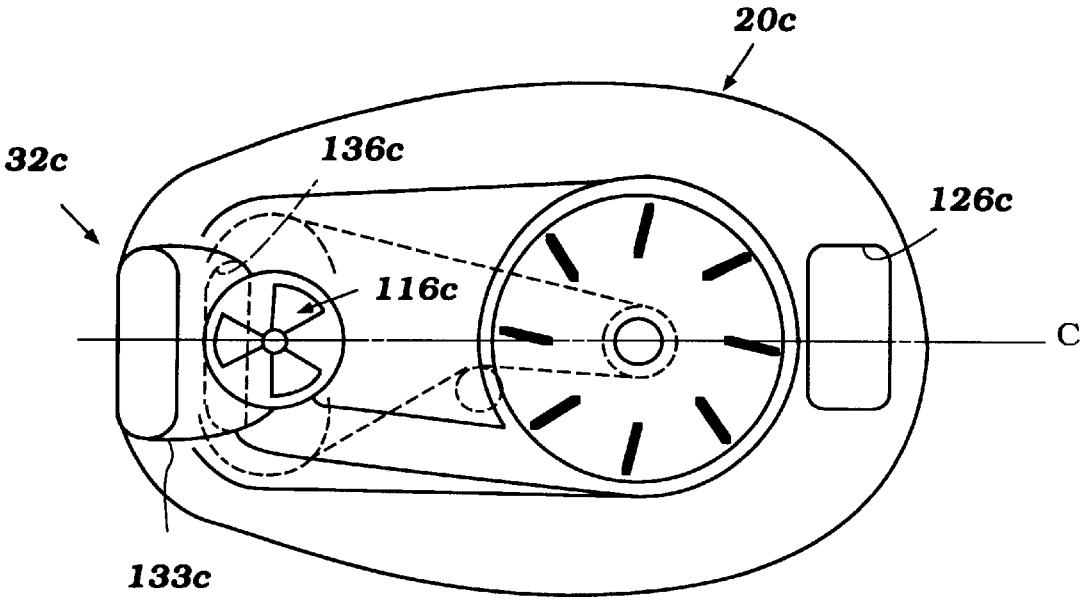
FIG. 7 is a top view of a powerhead portion of a motor arranged in a first manner when including the ventilating system illustrated in FIG. 6.
Figure 8:
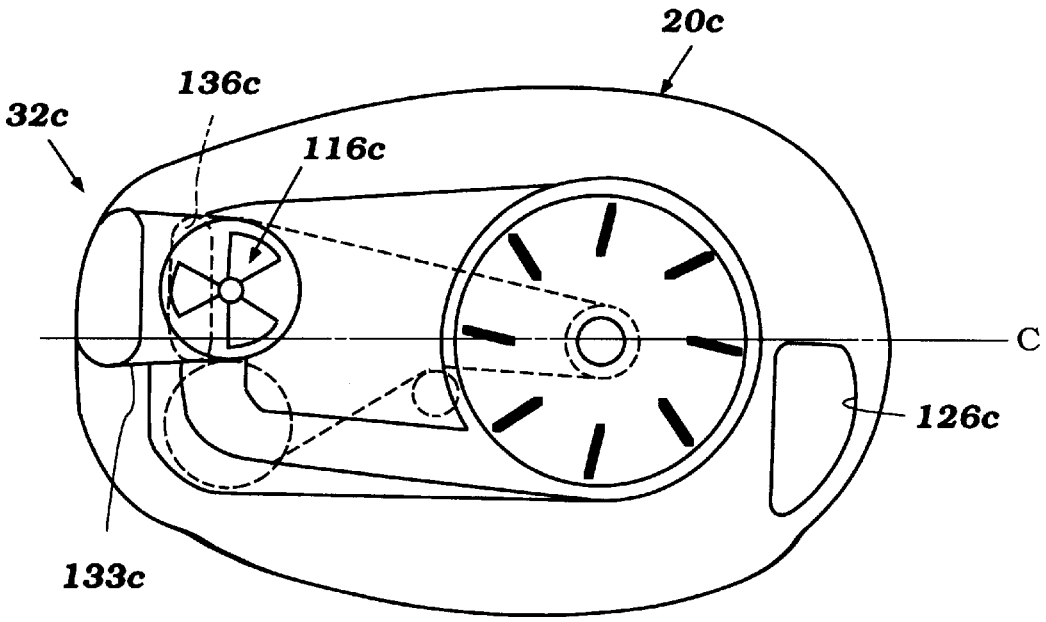
FIG. 8 is a top view of a powerhead portion of a motor arranged in a second manner when including the ventilating system illustrated in FIG. 6.

FIGS. 6–8 illustrate a third embodiment ventilating system in accordance with the present invention. This embodiment system is useful with an outboard motor of the type illustrated in FIG. 1 as modified as illustrated in these figures. In the description and illustration of this embodiment, like parts have been given like reference numerals to those utilized in the description of the embodiments above, except that a "c" designator has been added to all of the reference numerals used herein.

In this embodiment, the passage through the riser 88*c* which extends into the intake chamber of the intake 32*c* leads through a delivery duct 133*c* extending generally along the engine 22*c* from its top end to its bottom end. Air passes through an inlet 134*c* into the riser 88*c*, and then flows through the duct 133*c* to an outlet 136*c*. The outlet 136*c* is positioned at or near the bottom of the engine 22*c*.

Means are preferably provided for forcing air through the duct 133*c* and through the outlet 136*c* into the space within the cowling 30*c*. Preferably, this means comprises a fan 116*c*. As with the previous embodiment fan, this fan 116*c* preferably has at least one blade 120*c* driven by a motor 118*c*. The motor 118*c* may be operated by a circuit such as that illustrated in FIGS. 4 or 5.

In this arrangement, when the temperature within the cowling 30*c* is high, the fan 116*c* is turned on. The fan 116*c* draws air through the intake 32*c* and forces it through the duct 133*c*. This cool air is delivered towards the bottom of the engine 22*c*, and displaces hotter air, which flows through the exhaust vent 126*c* (as illustrated by the arrows in FIG. 6). In this manner, the space within the cowling 30*c* is cooled.

In addition, as in the previous embodiments, the fan 116*c* is preferably operated after the engine is shut off, for either a fixed period of time or until a temperature thereof or a temperature within the cowling 30*c* falls to a predetermined temperature.

FIGS. 7 and 8 illustrate two layouts for the air intake and exhaust 32*c*,126*c*. As illustrated in FIG. 7, the air intake and exhaust 32*c*,126*c* may be positioned along a centerline C passing through the motor 20*c* from its front end to its rear end. As illustrated in FIG. 8, the intake 32*c* is positioned at the top of the cowling 30*c* at a rear end generally on one side of a centerline C through the motor 20*c*, while the exhaust vent 126*c* is positioned at the top of the cowling 30*c* at the front end and on the opposite side of the centerline C. The arrangement illustrated in FIG. 8 causes the air which is delivered by the fan 116*c* through the intake duct 133*c* flows around and along the engine 22*c*, thereby cooling it effectively.

Those of skill in the art will appreciate that the fan used to expel air from within the cowling may be arranged in a variety of manners, such as having two, three or more blades, and may comprise a blower wheel or cage or similar structure known to those of skill in the art. Further, the blade(s) may be driven directly or indirectly. In the embodiments illustrated, the blades are driven directly in that the motor directly drives a shaft from which the blades extend. Of course, the motor may be arranged to drive the blades indirectly, such as by a pulley and belt system.

Also, the means for moving the blades may comprise other than an electric motor.

For example, the blades may be arranged to be turned by a belt connection to the output shaft of the engine. To control the activation of the blades in such an arrangement, an electrically operated clutch mechanism or the like may be employed.

Of course, the foregoing description is that of preferred embodiments of the invention, and various changes and modifications may be made without departing from the spirit and scope of the invention, as defined by the appended claims.

What is claimed is:

1. An outboard motor ventilating system, said outboard motor having a lower unit containing a water propulsion device for propelling an associated watercraft through a body of water and a power head positioned above said lower unit and containing an internal combustion engine positioned in an engine compartment defined by a surrounding cowling, the engine having an output shaft for driving said water propulsion device, said cowling having an air inlet for permitting air to flow into said engine compartment, said cowling further including an exhaust port, a cover for controlling the flow of air through said exhaust port, said cover being moveable between an open position for permitting flow through said exhaust port for cooling said engine compartment and a closed position for precluding air flow through said exhaust port, and control means for moving said cover between its closed position and its open position in response to a condition when said engine compartment will become overheated.

2. The ventilating system in accordance with claim 1, wherein said control means is arranged to hold said cover open only for a predetermined time after said condition has stopped.

3. The ventilating system in accordance with claim 1, wherein said control means is arranged to hold said cover open until a temperature of said engine falls to a predetermined temperature.

4. The ventilating system in accordance with claim 1, wherein said control means is arranged to hold said cover open until a temperature within said engine compartment falls to a predetermined temperature.

5. The ventilating system in accordance with claim 1, wherein said control means includes an electrically powered solenoid connected to said cover with a linkage.

* * * * *